US009222153B2

(12) United States Patent
Xiong et al.

(10) Patent No.: US 9,222,153 B2
(45) Date of Patent: Dec. 29, 2015

(54) TI(C,N)-BASED CERMET WITH NI3AL AND NI AS BINDER AND PREPARATION METHOD THEREOF

(71) Applicant: Huazhong University of Science and Technology, Wuhan (CN)

(72) Inventors: Weihao Xiong, Wuhan (CN); Bin Huang, Wuhan (CN); Qingqing Yang, Wuhan (CN); Mingkun Chen, Wuhan (CN); Zhenhua Yao, Wuhan (CN); Guopeng Zhang, Wuhan (CN); Xiao Chen, Wuhan (CN); Shan Chen, Wuhan (CN)

(73) Assignee: HUAZHONG UNIVERSITY OF SCIENCE AND TECHNOLOGY, Wuhan (CN)

( * ) Notice: Subject to any disclaimer, the term of this patent is extended or adjusted under 35 U.S.C. 154(b) by 0 days.

(21) Appl. No.: 14/587,395

(22) Filed: Dec. 31, 2014

(65) Prior Publication Data

US 2015/0252455 A1 Sep. 10, 2015

(30) Foreign Application Priority Data

Mar. 7, 2014 (CN) ..... 2014 1 0082829

(51) Int. Cl.

| | |
|---|---|
| ***C22C 29/02*** | (2006.01) |
| ***B22F 3/12*** | (2006.01) |
| ***B22F 3/22*** | (2006.01) |
| ***B22F 9/04*** | (2006.01) |
| ***C22C 29/00*** | (2006.01) |

(52) U.S. Cl.

CPC . *C22C 29/02* (2013.01); *B22F 3/12* (2013.01); *B22F 3/22* (2013.01); *B22F 9/04* (2013.01); *C22C 29/005* (2013.01); *B22F 2009/041* (2013.01); *B22F 2009/043* (2013.01)

(58) Field of Classification Search

CPC ..... C22C 29/02; B22F 3/12
USPC ..... 75/238
See application file for complete search history.

*Primary Examiner* — Weiping Zhu

(74) *Attorney, Agent, or Firm* — Davis Wright Tremaine LLP

(57) ABSTRACT

Provided are Ti(C,N)-based cermets with $Ni_3Al$ and Ni as binder and a preparation method thereof. The Ti(C,N)-based cermets are prepared by raw materials subjected to ball-mill mixing, die forming, vacuum degreasing and vacuum sintering, wherein weight percentage of each chemical component of the raw materials is as follows: TiC 34.2~43%, TiN 8~15%, Mo 10~15%, WC 5~10%, graphite 0.8~1.0%, Ni 20~24%, and $Ni_3Al$ powder containing B 6~10%. Ni powder and $Ni_3Al$ powder containing B are used as binder. The Ti(C,N)-based cermets feature in excellent corrosion resistance, oxidation resistance and mechanical properties at high temperature, has a hardness of 89.0~91.9 HRA, a room temperature bending strength of 1600 MPa or more, and a fracture toughness of 14 $MPa \cdot m^{1/2}$ or more, and is applicable for manufacturing high-speed cutting tools, dies and heat-resisting and corrosion-resisting components.

13 Claims, 1 Drawing Sheet

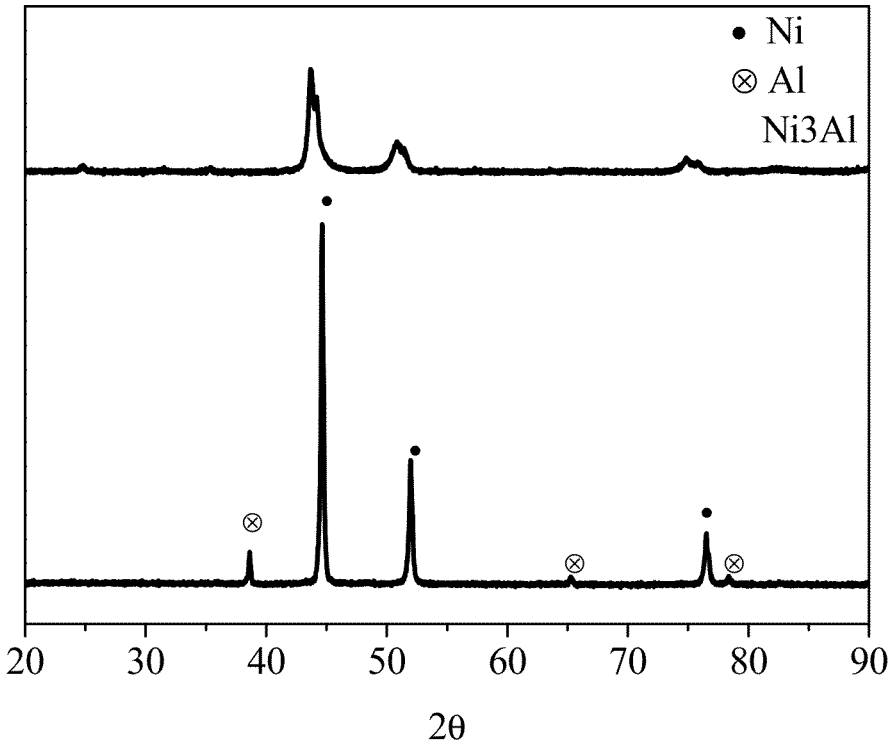
• Ni
⊗ Al
Ni3Al
20
30
40
50
60
70
80
90
2θ

TI(C,N)-BASED CERMET WITH NI3AL AND NI AS BINDER AND PREPARATION METHOD THEREOF

CROSS-REFERENCE TO RELATED APPLICATION

The present application claims priority to Chinese Application No. 2014100828290, filed on Mar. 7, 2014, which is hereby incorporated by reference in its entirety.

FIELD OF THE INVENTION

The invention relates to technical fields of cermets materials and powder metallurgy, and more particularly to Ti(C,N)-based cermets with $Ni_3Al$ and Ni as binder and a preparation method thereof.

BACKGROUND OF THE INVENTION

In the late 1920s and the early 1930s, in order to solve the problem of W and Co shortage faced by conventional WC—Co carbide materials and to meet the urgent demand of manufacturing development for high level tools and dies, Germany initiated to prepare TiC-based cermets by substituting TiC with high melting point, high hardness and abundant reservation for WC as ceramic phase, and by substituting Ni with superior chemical stability and abundant reservation for Co as metal binder. However, it is hard for TiC—Ni cermets to reach high toughness due to poor wettability of Ni with respect to Ti(C,N) particles, which makes it can hardly be used. In 1956, Ford Motor Company found that wettability of Ni with respect to TiC ceramic grains can be improved by introducing an appropriate amount of Mo into TiC—Ni cermets which leads to significantly reduced sizes of ceramic grains and densification of the sintered body, so that flexural strength of the material can be significantly improved. This finding is a significant technical breakthrough for preparation of TiC-based cermets. In 1971, R. Kieffer etc. from University of Vienna, Austria found that mechanical properties of TiC—$Mo_2C$—Ni cermets at room and elevated temperatures can be significantly improved by introducing an appropriate amount of TiN, which leads to a research boom in Ti(C,N)-based cermets.

Intermetallic compound $Ni_3Al$ holds excellent characteristics of high specific stiffness, high elastic modulus, low density, and superior corrosion resistance and oxidation resistance at high temperature, besides, yield strength thereof increases with the temperature and reaches maximum values at 700~900° C. Therefore, it may help improve corrosion resistance, oxidation resistance and mechanical properties at high temperature of Ti(C,N)-based cermets using $Ni_3Al$ as binder. However, since $Ni_3Al$ has poor ductility at room temperature, Ti(C,N)-based cermets with $Ni_3Al$ as binder features low toughness and high brittleness, which makes it impossible for engineering applications.

SUMMARY OF THE INVENTION

In view of the above-mentioned problems, it is an objective of the invention to provide Ti(C,N)-based cermets with $Ni_3Al$ and Ni as binder and a preparation method thereof so as to obtain a Ti(C,N)-based cermet with not only excellent toughness, but also excellent corrosion resistance, oxidation resistance and mechanical properties at high temperature.

To achieve the above objective, in accordance with one embodiment of the invention, there is provided Ti(C,N)-based cermets with $Ni_3Al$ and Ni as binder, prepared by raw materials subjected to ball-mill mixing, die forming, vacuum degreasing and vacuum sintering, wherein the raw materials comprise TiC, TiN, Mo, WC, graphite, Ni powder and $Ni_3Al$ powder containing B, and weight percentage of each chemical component of the raw materials is as follows: TiC 34.2~43%, TiN 8~15%, Mo 10~15%, WC 5~10%, graphite 0.8~1.0%, Ni 20~24%, and $Ni_3Al$ powder containing B 6~10%, and weight percentage of each element of the $Ni_3Al$ powder containing B is as follows: Ni 87.23~88.48%, Al 11.47~12.68%, and B 0.5~1.0%.

In accordance with another embodiment of the invention, there are provided Ti(C,N)-based cermets with $Ni_3Al$ and Ni as binder, comprising chemical components of TiC, TiN, Mo, WC, graphite, Ni powder and $Ni_3Al$ powder containing B, weight percentage of each chemical component is as follows: TiC 34.2~43%, TiN 8~15%, Mo 10~15%, WC 5~10%, graphite 0.8~1.0%, Ni 20~24%, and $Ni_3Al$ powder containing B 6~10%, and weight percentage of each element of the $Ni_3Al$ powder containing B is as follows: Ni 87.23~88.48%, Al 11.47~12.68%, and B 0.5~1.0%.

In accordance with still another embodiment of the invention, there is provided a method for preparing the Ti(C,N)-based cermets, comprising steps of preparing $Ni_3Al$ powder, ball-mill mixing, die forming, vacuum degreasing and vacuum sintering, wherein (1) preparing $Ni_3Al$ powder: preparing a mixture of Ni, Al and B powders each having a purity of 99.0% or more, and weight percentage of each of the powders being as follows: Ni 87.23~88.48%, Al 11.47~12.68%, and B 0.5~1.0%; ball-milling the mixture with ethyl alcohol whereby obtaining a uniformly mixed slurry; drying the mixed slurry and performing vacuum heating thereafter whereby obtaining a $Ni_3Al$ sintering block containing B with a porous and loose structure; and smashing the $Ni_3Al$ sintering block whereby obtaining $Ni_3Al$ powder containing B;

(2) conducting ball-mill mixing with $Ni_3Al$ powder containing B: preparing cermets mixture with TiC, TiN, Mo, WC, graphite, Ni powder and the $Ni_3Al$ powder containing B as raw materials, a weight percentage of each of the raw materials being as follows: TiC 34.2~43%, TiN 8~15%, Mo 10~15%, WC 5~10%, graphite 0.8~1.0%, Ni 20~24%, and $Ni_3Al$ powder containing B 6~10%; and performing ball-milling on cermets mixture with ethyl alcohol whereby obtaining uniformly mixed cermets slurry;

(3) performing die forming on cermets slurries: drying and sieving cermets slurry, adding polyethylene glycol (PEG) with a weight percentage of 1%~2% thereto as binder, and performing die forming under the pressure of 250 MPa~400 MPa whereby obtaining green compacts;

(4) performing vacuum degreasing on green compacts: degreasing the green compacts in vacuum under the temperature of 250° C.~350° C. for 4 h~10 h whereby obtaining degreased green compacts; and (5) performing vacuum sintering on the degreased green compacts: sintering the degreased green compacts in vacuum under the temperature of 1450° C.~1490° C. for 0.75 h~1.5 h whereby obtaining sintered cermets.

In a class of this embodiment, in the step of preparing $Ni_3Al$ powder, ball-milling is performed with ethanol as milling dispersant and carbide ball as milling media, a mass ratio of ball to material of 5:1~10:1, a rotating speed of 150 rpm~250 rpm, and a milling duration of 12 h~24 h, and vacuum heating is performed under the temperature of 1000° C.~1200° C. with a duration of 1 h~1.5 h.

In a class of this embodiment, in the step of ball-mill mixing, ball-milling is performed with ethanol as milling dispersant and carbide ball as milling media, a mass ratio of ball to material of 7:1~10:1, a rotating speed of 150 rpm~250 rpm, and a milling duration of 36 h~48 h. Researches show that $Ni_3Al$ has certain wettability and certain solubility with respect to TiC, TiN and WC, and adding Mo may improve the wettability therebetween. Researches also show that yield strength of $Ni_3Al$ increases with the temperature and reaches a maximum value at 900° C. However, $Ni_3Al$ has high brittleness, including intrinsic brittleness and environmental brittleness, mainly for the following reasons: (a) valence and electronegativity between a Ni atom and an Al atom in $Ni_3Al$ differ greatly which leads to weak grain bond strength; (b) grain boundary sliding is difficult for maintaining chemical ordering of grain boundaries of $Ni_3Al$; and (c) cylindrical micropores on an atomic scale exist in $Ni_3Al$ and become crack sources when sliding occurs. Environmental brittleness mainly relates to ambient water vapor. Specifically, $Ni_3Al$ reacts with ambient water vapor absorbing O atoms and releasing H atoms, and the H atoms are absorbed to the grain boundaries which leads to grain boundary brittleness. Grain boundary brittleness of $Ni_3Al$ may be effectively relieved by adding B and researches show that toughness of $Ni_3Al$ may be improved by 50% or more by alloying B with a weight percentage of 0.1%. B segregates at grain boundaries and reduces grain boundary brittleness mainly through two mechanisms: (a) improving bonding strength of the grain boundaries; (b) making grain boundary sliding possible and segregated B at the grain boundaries preventing H atoms from diffusing along the grain boundaries. The present invention improves room temperature ductility and toughness of $Ni_3Al$ binder significantly by adding a slight amount of B thereto and makes it possible for $Ni_3Al$ to be used as a binding phase of cermets.

The preparation method of the invention, considering the overall performance, prepares $Ni_3Al$ containing B by alloying, adds Ni thereto by a certain percentage, and uses the mixture of Ni powder and $Ni_3Al$ containing B as binder for Ti(C,N)-based cermets, which can not only improve corrosion resistance, oxidation resistance and mechanical properties at high temperature of Ti(C,N)-based cermets, but also ensure excellent mechanical properties thereof at room temperature.

The Ti(C,N)-based cermets of the present invention features in excellent corrosion resistance, oxidation resistance and mechanical properties at high temperature, has a hardness of 89.0~91.9 HRA, a room temperature bending strength of 1600 MPa or more, and a fracture toughness of 14 $MPa \cdot m^{1/2}$ or more, and is applicable for manufacturing high-speed cutting tools, dies and heat-resisting and corrosion-resisting components.

BRIEF DESCRIPTION OF THE ACCOMPANYING DRAWINGS

FIG. 1 shows X-ray diffraction spectrums of $Ni_3Al$ powder containing B in a group A1 before and after vacuum heating according to a first embodiment of the present invention.

SPECIFIC EMBODIMENTS OF THE INVENTION

For clear understanding of the objectives, features and advantages of the invention, detailed description of the invention will be given below in conjunction with accompanying drawings and specific embodiments. It should be noted that the embodiments are only meant to explain the invention, and not to limit the scope of the invention.

The present invention will be described hereinafter in conjunction with specific embodiments. A method for preparing a Ti(C,N)-based cermet of a first embodiment of the invention comprises steps of:

(1) preparing $Ni_3Al$ powder: preparing four groups of mixtures A1, A2, A3 and A4 with Ni, Al and B powders as raw materials, each of which has a purity of 99.0% or more, according to weight percentages of Table 1, average particle size, purity and oxygen content of each of the raw materials are listed in Table 2;

performing ball-milling on the four groups of mixtures with ethyl alcohol respectively whereby obtaining a uniformly mixed slurry for each group, drying the mixed slurries and performing vacuum heating thereafter whereby obtaining a $Ni_3Al$ sintering block containing B with a porous and loose structure for each group, and smashing the $Ni_3Al$ sintering blocks containing B whereby obtaining four groups of $Ni_3Al$ powder containing B A1~A4, where ball-milling is performed with ethanol as milling dispersant and carbide ball as milling media, and process parameters of ball-milling and vacuum heating are shown in Table 3, and a mass ratio of ball to material is 5:1~10:1, a rotating speed is 150 rpm~250 rpm, a milling duration is 12 h~24 h, and vacuum heating is performed under the temperature of 1000° C.~1200° C. with a duration of 1 h~1.5 h;

XRD analysis is performed on $Ni_3Al$ powder containing B of group A1 before and after vacuum heating; the result therefrom is shown in FIG. 1, where the horizontal axis represents diffraction angle 2θ with a unit of °, the vertical axis represents intensity, the lower curve is the X-ray diffraction spectrum of the mixture before vacuum heating, and the upper curve is the X-ray diffraction spectrum of $Ni_3Al$ powder containing B after vacuum heating; and it indicates that $Ni_3Al$ powder containing B is successfully obtained according to standard Powder Diffraction File (PDF) of $Ni_3Al$;

TABLE 1

| No. | nominal composition (molar ratio) | Ni (wt. %) | Al (wt. %) | B (wt. %) |
|---|---|---|---|---|
| A1 | $Ni_{76}Al_{24}$ | 87.27 | 12.68 | 0.50 |
| A2 | $Ni_{76}Al_{24}$ | 87.23 | 12.67 | 1.00 |
| A3 | $Ni_{78}Al_{22}$ | 88.48 | 11.47 | 0.50 |
| A4 | $Ni_{78}Al_{22}$ | 88.43 | 11.47 | 1.00 |

TABLE 2

| powder | average size (μm) | oxygen content (weight percentage) | Purity (weight percentage) |
|---|---|---|---|
| Ni | 2.6 | <0.02 | >99.9 |
| Al | 55 | <0.1 | >99 |
| B | 5.1 | <0.01 | >99.9 |

TABLE 3

| | process parameter | A1 | A2 | A3 | A4 |
|---|---|---|---|---|---|
| ball-milling | ball to material (mass ratio) | 5:1 | 6:1 | 8:1 | 10:1 |
| | rotating speed (rpm) | 150 | 250 | 200 | 250 |
| | milling duration (h) | 12 | 16 | 20 | 24 |
| vacuum heating | temperature (° C.) | 1000 | 1100 | 1150 | 1200 |
| | duration (h) | 1.5 | 1.5 | 1 | 1 |

(2) performing ball-mill mixing with the $Ni_3Al$ powder: preparing twelve groups of cermets mixtures B1~B12 with TiC, TiN, Mo, WC, graphite, Ni powder and the $Ni_3Al$ powder containing B as raw materials according to weight percentages of each of the raw materials shown in Table 4; and ball-milling the twelve groups of cermets mixtures with water respectively whereby obtaining twelve groups of uniformly mixed cermets slurries B1~B12, where ball-milling is performed with ethanol as milling dispersant, carbide ball as milling media, a mass ratio of ball to material of 7:1~10:1, a rotating speed of 150 rpm~250 rpm, and a milling duration of 36 h~48 h, and process parameters of ball-milling for each group of cermet mixture are shown in Table 5, where groups B1~B3 correspond to the $Ni_3Al$ powder containing B of group A1, groups B4~B6 correspond to the $Ni_3Al$ powder containing B of group A2, groups B7~B9 correspond to the $Ni_3Al$ powder containing B of group A3, and groups B10~B12 correspond to the $Ni_3Al$ powder containing B of group A4;

TABLE 4

| No. | No. of $Ni_3Al$ | TiC | TiN | Mo | WC | C | Ni | $Ni_3Al$ |
|---|---|---|---|---|---|---|---|---|
| B1 | A1 | 39.2 | 15 | 10 | 5 | 0.8 | 24 | 6 |
| B2 | | 39.2 | 15 | 10 | 5 | 0.8 | 22.5 | 7.5 |
| B3 | | 39.2 | 15 | 10 | 5 | 0.8 | 20 | 10 |
| B4 | A2 | 39.2 | 15 | 10 | 5 | 0.8 | 24 | 6 |
| B5 | | 39.2 | 15 | 10 | 5 | 0.8 | 22.5 | 7.5 |
| B6 | | 39.2 | 15 | 10 | 5 | 0.8 | 20 | 10 |
| B7 | A3 | 39.2 | 15 | 10 | 5 | 0.8 | 24 | 6 |
| B8 | | 39.2 | 15 | 10 | 5 | 0.8 | 22.5 | 7.5 |
| B9 | | 39.2 | 15 | 10 | 5 | 0.8 | 20 | 10 |
| B10 | A4 | 39.2 | 15 | 10 | 5 | 0.8 | 24 | 6 |
| B11 | | 39.2 | 15 | 10 | 5 | 0.8 | 22.5 | 7.5 |
| B12 | | 39.2 | 15 | 10 | 5 | 0.8 | 20 | 10 |

(3) performing die forming on the cermets slurries: drying and sieving the twelve groups of cermets slurries, adding polyethylene glycol (PEG) with a weight percentage of 1%~2% thereto respectively as binder, and performing die forming under the pressure of 250 MPa~400 MPa whereby obtaining twelve groups of green compacts;

(4) performing vacuum degreasing on the green compacts: degreasing the twelve groups of green compacts in vacuum under the temperature of 250° C.~350° C. for 4 h~10 h whereby obtaining twelve groups of degreased green compacts;

(5) performing vacuum sintering on the degreased green compacts: sintering the twelve groups of degreased green compacts in vacuum under the temperature of 1450° C.~1490° C. for 0.75 h~1.5 h whereby obtaining twelve groups of sintered cermets, where process parameters of die forming, vacuum degreasing and vacuum sintering for each group of cermet slurry are shown in Table 5, where groups B1~B3 correspond to the $Ni_3Al$ powder containing B of group A1, groups B4~B6 correspond to the $Ni_3Al$ powder containing B of group A2, groups B7~B9 correspond to the $Ni_3Al$ powder containing B of group A3, and groups B10~B12 correspond to the $Ni_3Al$ powder containing B of group A4; and

TABLE 5

| | | No. of $Ni_3Al$ | | | |
|---|---|---|---|---|---|
| | process parameter | A1 | A2 | A3 | A4 |
| ball-milling | rotating speed (rpm) | 150 | 200 | 250 | 250 |
| | milling duration (h) | 48 | 48 | 36 | 36 |
| | ball to material (mass ratio) | 7:1 | 8:1 | 9:1 | 10:1 |

TABLE 5-continued

| | | No. of $Ni_3Al$ | | | |
|---|---|---|---|---|---|
| | process parameter | A1 | A2 | A3 | A4 |
| die forming | PEG content (weight percentage) | 1 | 2 | 1.5 | 2 |
| | pressure (MPa) | 400 | 300 | 250 | 350 |
| vacuum degreasing | degreasing temperature (° C.) | 250 | 250 | 350 | 350 |
| | holding time (h) | 10 | 8 | 6 | 4 |
| vacuum sintering | sintering temperature (° C.) | 1450 | 1490 | 1470 | 1490 |
| | holding time (h) | 1.5 | 0.75 | 1 | 1 |

(6) performing coarse grinding on each of the twelve groups of sintered cermets, hardness, bending strength and fracture toughness thereof are tested thereafter, and the results are shown in Table 6.

TABLE 6

| No. | hardness (HRA) | bending strength (MPa) | fracture toughness (MPa $m^{1/2}$) |
|---|---|---|---|
| B1 | 89.1 | 1620 | 15.02 |
| B2 | 89.4 | 1639 | 14.04 |
| B3 | 90.1 | 1625 | 13.98 |
| B4 | 89.7 | 1635 | 15.07 |
| B5 | 90.1 | 1643 | 15.01 |
| B6 | 91.0 | 1634 | 14.05 |
| B7 | 89.0 | 1640 | 14.19 |
| B8 | 89.4 | 1649 | 14.33 |
| B9 | 90.2 | 1645 | 14.92 |
| B10 | 90.7 | 1655 | 15.07 |
| B11 | 91.4 | 1643 | 15.01 |
| B12 | 91.9 | 1663 | 15.03 |

A method for preparing the Ti(C,N)-based cermets of a second embodiment of the invention comprises steps of:

(1) preparing $Ni_3Al$ powder in the same way as the first embodiment whereby obtaining four groups of $Ni_3Al$ powder containing B A1~A4;

(2) performing ball-mill mixing with the $Ni_3Al$ powder containing B 4: preparing twelve groups of cermets mixtures C1~C12 with TiC, TiN, Mo, WC, graphite, Ni powder and the $Ni_3Al$ powder containing B as raw materials according to weight percentages of each of the raw materials shown in Table 7; and ball-milling the twelve groups of cermets mixtures with water respectively whereby obtaining twelve groups of uniformly mixed cermets slurries C1~C12, where ball-milling is performed with ethanol as milling dispersant, carbide ball as milling media, a mass ratio of ball to material of 7:1~10:1, a rotating speed of 150 rpm~250 rpm, and a milling duration of 36 h~48 h, and process parameters of ball-milling for each group of cermet mixture are shown in Table 5, where groups C1~C3 correspond to the $Ni_3Al$ powder containing B of group A1, groups C4~C6 correspond to the $Ni_3Al$ powder containing B of group A2, groups C7~C9 correspond to the $Ni_3Al$ powder containing B of group A3, and groups C10~C12 correspond to the $Ni_3Al$ powder containing B of group A4;

TABLE 7

| No. | No. of $Ni_3Al$ | TiC | TiN | Mo | WC | C | Ni | $Ni_3Al$ |
|---|---|---|---|---|---|---|---|---|
| C1 | A1 | 34.2 | 10 | 15 | 10 | 0.8 | 24 | 6 |
| C2 | | 34.2 | 10 | 15 | 10 | 0.8 | 22.5 | 7.5 |

TABLE 7-continued

| No. | No. of $Ni_3Al$ | TiC | TiN | Mo | WC | C | Ni | $Ni_3Al$ |
|---|---|---|---|---|---|---|---|---|
| C3 | | 34.2 | 10 | 15 | 10 | 0.8 | 20 | 10 |
| C4 | A2 | 34.2 | 10 | 15 | 10 | 0.8 | 24 | 6 |
| C5 | | 34.2 | 10 | 15 | 10 | 0.8 | 22.5 | 7.5 |
| C6 | | 34.2 | 10 | 15 | 10 | 0.8 | 20 | 10 |
| C7 | A3 | 39 | 10 | 10 | 10 | 1.0 | 24 | 6 |
| C8 | | 39 | 10 | 10 | 10 | 1.0 | 22.5 | 7.5 |
| C9 | | 39 | 10 | 10 | 10 | 1.0 | 20 | 10 |
| C10 | A4 | 39 | 10 | 10 | 10 | 1.0 | 24 | 6 |
| C11 | | 39 | 10 | 10 | 10 | 1.0 | 22.5 | 7.5 |
| C12 | | 39 | 10 | 10 | 10 | 1.0 | 20 | 10 |

(3) performing die forming on the cermet slurry: drying and sieving the twelve groups of cermets slurries, adding polyethylene glycol (PEG) with a weight percentage of 1%~2% thereto respectively as binder, and performing die forming under the pressure of 250 MPa~400 MPa whereby obtaining twelve groups of green compacts;

(4) performing vacuum degreasing on the green compacts: degreasing the twelve groups of green compacts in vacuum under the temperature of 250° C.~350° C. for 4 h~10 h whereby obtaining twelve groups of degreased green compacts;

(5) performing vacuum sintering on the degreased green compacts: sintering the twelve groups of degreased green compacts in vacuum under the temperature of 1450° C.~1490° C. for 0.75 h~1.5 h whereby obtaining twelve groups of sintered cermets, where process parameters of die forming, vacuum degreasing and vacuum sintering for each group of cermet slurry are shown in Table 5, where groups C1~C3 correspond to the $Ni_3Al$ powder containing B of group A1, groups C4~C6 correspond to the $Ni_3Al$ powder containing B of group A2, groups C7~C9 correspond to the $Ni_3Al$ powder containing B of group A3, and groups C10~C12 correspond to the $Ni_3Al$ powder containing B of group A4; and (6) performing coarse grinding on each of the twelve groups of sintered cermets, hardness, bending strength and fracture toughness thereof are tested thereafter, and the results are shown in Table 8.

TABLE 8

| No. | hardness (HRA) | bending strength (MPa) | fracture toughness ($MPaM^{1/2}$) |
|---|---|---|---|
| C1 | 89.1 | 1637 | 14.32 |
| C2 | 89.7 | 1649 | 14.04 |
| C3 | 90.1 | 1644 | 14.18 |
| C4 | 89.7 | 1655 | 14.47 |
| C5 | 90.0 | 1673 | 15.11 |
| C6 | 90.4 | 1664 | 15.25 |
| C7 | 90.1 | 1680 | 14.29 |
| C8 | 90.4 | 1653 | 14.43 |
| C9 | 91.1 | 1651 | 14.97 |
| C10 | 90.7 | 1715 | 14.77 |
| C11 | 91.0 | 1683 | 15.11 |
| C12 | 91.7 | 1693 | 15.33 |

A method for preparing the Ti(C,N)-based cermet of a third embodiment of the invention comprises steps of:

(1) preparing $Ni_3Al$ powder in the same way as the first embodiment whereby obtaining four groups of $Ni_3Al$ powder containing B A1~A4;

(2) performing ball-mill mixing with the $Ni_3Al$ powder containing B: preparing twelve groups of cermets mixtures D1~D12 with TiC, TiN, Mo, WC, graphite, Ni powder and the $Ni_3Al$ powder containing B as raw materials according to weight percentages of each of the raw materials shown in Table 9; and ball-milling the twelve groups of cermets mixtures with water respectively whereby obtaining twelve groups of uniformly mixed cermets slurries D1~D12, where ball-milling is performed with ethanol as milling dispersant, carbide ball as milling media, a mass ratio of ball to material of 7:1~10:1, a rotating speed of 150 rpm~250 rpm, and a milling duration of 36 h~48 h, and process parameters of ball-milling for each group of cermets mixture are shown in Table 5, where groups D1~D3 correspond to the $Ni_3Al$ powder containing B of group A1, groups D4~D6 correspond to the $Ni_3Al$ powder containing B of group A2, groups D7~D9 correspond to the $Ni_3Al$ powder containing B of group A3, and groups D10~D12 correspond to the $Ni_3Al$ powder containing B of group A4;

TABLE 9

| No. | No. of $Ni_3Al$ | TiC | TiN | Mo | WC | C | Ni | $Ni_3Al$ |
|---|---|---|---|---|---|---|---|---|
| D1 | A1 | 36.2 | 12 | 13 | 8 | 0.8 | 24 | 6 |
| D2 | | 36.2 | 12 | 13 | 8 | 0.8 | 22.5 | 7.5 |
| D3 | | 36.2 | 12 | 13 | 8 | 0.8 | 20 | 10 |
| D4 | A2 | 36.2 | 12 | 13 | 8 | 0.8 | 24 | 6 |
| D5 | | 36.2 | 12 | 13 | 8 | 0.8 | 22.5 | 7.5 |
| D6 | | 36.2 | 12 | 13 | 8 | 0.8 | 20 | 10 |
| D7 | A3 | 43 | 8 | 10 | 8 | 1.0 | 24 | 6 |
| D8 | | 43 | 8 | 10 | 8 | 1.0 | 22.5 | 7.5 |
| D9 | | 43 | 8 | 10 | 8 | 1.0 | 20 | 10 |
| D10 | A4 | 43 | 8 | 10 | 8 | 1.0 | 24 | 6 |
| D11 | | 43 | 8 | 10 | 8 | 1.0 | 22.5 | 7.5 |
| D12 | | 43 | 8 | 10 | 8 | 1.0 | 20 | 10 |

(3) performing die forming on the cermets slurries: drying and sieving the twelve groups of cermets slurries, adding polyethylene glycol (PEG) with a weight percentage of 1%~2% thereto respectively as binder, and performing die forming under the pressure of 250 MPa~400 MPa whereby obtaining twelve groups of green compacts;

(4) performing vacuum degreasing on the green compacts: degreasing the twelve groups of green compacts in vacuum under the temperature of 250° C.~350° C. for 4 h~10 h whereby obtaining twelve groups of degreased green compacts;

(5) performing vacuum sintering on the degreased green compacts: sintering the twelve groups of degreased green compacts in vacuum under the temperature of 1450° C.~1490° C. for 0.75 h~1.5 h whereby obtaining twelve groups of sintered cermets, where process parameters of die forming, vacuum degreasing and vacuum sintering for each group of cermet slurry are shown in Table 5, where groups D1~D3 correspond to the $Ni_3Al$ powder containing B of group A1, groups D4~D6 correspond to the $Ni_3Al$ powder containing B of group A2, groups D7~D9 correspond to the $Ni_3Al$ powder containing B of group A3, and groups D10~D12 correspond to the $Ni_3Al$ powder containing B of group A4; and (6) performing coarse grinding on each of the twelve groups of sintered cermets, hardness, bending strength and fracture toughness thereof are tested thereafter, and the results are shown in Table 10.

TABLE 10

| No. | hardness (HRA) | bending strength (MPa) | fracture toughness ($MPaM^{1/2}$) |
|---|---|---|---|
| D1 | 89.9 | 1646 | 14.42 |
| D2 | 90.7 | 1639 | 14.17 |

TABLE 10-continued

| No. | hardness (HRA) | bending strength (MPa) | fracture toughness ($MPaM^{1/2}$) |
|---|---|---|---|
| D3 | 91.1 | 1624 | 14.22 |
| D4 | 89.5 | 1655 | 14.67 |
| D5 | 91.0 | 1643 | 15.10 |
| D6 | 90.7 | 1654 | 15.15 |
| D7 | 89.4 | 1694 | 14.59 |
| D8 | 90.0 | 1683 | 14.87 |
| D9 | 90.4 | 1681 | 14.43 |
| D10 | 89.9 | 1725 | 14.71 |
| D11 | 90.1 | 1713 | 15.01 |
| D12 | 90.3 | 1693 | 15.23 |

Ti(C,N)-based cermets of a further embodiment of the invention has $Ni_3Al$ and Ni as binder, and is prepared by raw materials subjected to ball-mill mixing, die forming, vacuum degreasing and vacuum sintering as explained hereinbefore, the raw materials comprise TiC, TiN, Mo, WC, graphite, Ni powder and $Ni_3Al$ powder containing B, and weight percentage of each chemical component of the raw materials is as follows: TiC 34.2~43%, TiN 8~15%, Mo 10~15%, WC 5~10%, graphite 0.8~1.0%, Ni 20~24%, and $Ni_3Al$ powder containing B 6~10%; and weight percentage of each element of the $Ni_3Al$ powder containing B is as follows: Ni 87.23~88.48%, Al 11.47~12.68%, and B 0.5~1.0%.

While preferred embodiments of the invention have been described above, the invention is not limited to disclosure in the embodiments and the accompanying drawings. Any changes or modifications without departing from the spirit of the invention fall within the scope of the invention.

What is claimed is:

1. A Ti(C,N)-based cermet with $Ni_3Al$ and Ni as binder materials, prepared by subjecting raw materials to ball-mill mixing, die forming, vacuum degreasing, and vacuum sintering, wherein:

raw materials for preparing the cermets comprise TiC, TiN, Mo, WC, graphite, Ni powder, and $Ni_3Al$ powder containing B, wherein each component of the raw materials has a weight percentage as follows: TiC 34.2-43%, TiN 8-15%, Mo 10-15%, WC 5-10%, graphite 0.8 -1.0%, Ni powder 20-24%, and $Ni_3Al$ powder containing B 6-10%; and each element of the $Ni_3Al$ powder containing B has a weight percentage as follows: Ni 87.23-88.48%, Al 11.47-12.68%, and B 0.5-1.0%.

2. A method for preparing the Ti(C,N)-based cermets of claim 1, comprising steps of:

(1 ) preparing $Ni_3Al$ powder: preparing a mixture of Ni, Al, and B powders each having a purity of 99.0% or more, wherein each of the powders has a weight percentage as follows: Ni 87.23-88.48%, Al 11.47-12.68%, and B 0.5-1.0%; ball-milling the mixture with water, thereby obtaining a uniformly mixed slurry; drying the mixed slurry and performing vacuum heating thereafter, thereby obtaining a $Ni_3Al$ sintering block containing B with a porous and loose structure; and smashing the $Ni_3Al$ sintering block containing B, thereby obtaining $Ni_3Al$ powder containing B;

(2 ) conducting ball-mill mixing with $Ni_3Al$ powder containing B: preparing a cermet mixture with TiC, TiN, Mo, WC, graphite, Ni powder, and the $Ni_3Al$ powder containing B as raw materials, wherein each of the raw materials has a weight percentage as follows: TiC 34.2-43%, TiN 8-15%, Mo 10-15%, WC 5-10%, graphite 0.8-1.0%, Ni 20-24%, and $Ni_3Al$ powder containing B 6-10%; and performing ball-milling on the cermet mixture with ethyl alcohol, thereby obtaining a uniformly mixed cermet slurry;

(3) performing die forming on the cermet slurries: drying and sieving the cermet slurries, adding polyethylene glycol (PEG) thereto as a binder, and performing die forming under pressure, thereby obtaining a green compact;

(4) performing vacuum degreasing on the green compact: degreasing the green compact under vacuum at an elevated temperature, thereby obtaining a degreased green compact; and (5) performing vacuum sintering on the degreased green compact: sintering the degreased green compact under vacuum at an elevated temperature, thereby obtaining sintered cermets.

3. The method of claim 2, wherein the PEG has a weight percentage of 1-2%.

4. The method of claim 2, wherein the vacuum degreasing is performed at a temperature of 250° C.-350° C. for 4-10 hours.

5. The method of claim 2, wherein the vacuum sintering is performed at a temperature of 1450° C.-1490° C. for 0.75-1.5 hours.

6. The method of claim 2, wherein in the step of preparing $Ni_3Al$ powder, ball-milling is performed with ethanol as milling dispersant and carbide ball as milling media, a mass ratio of ball to material of 5:1-10:1, a rotating speed of 150 rpm-250 rpm, and a milling duration of 12-24 hours, and vacuum heating is performed at a temperature of 1000° C.-1200° C. for a duration of 1-1.5 hours.

7. The method of claim 2, wherein in the step of ball-mill mixing, ball-milling is performed with ethanol as milling dispersant and carbide ball as milling media, a mass ratio of ball to material of 7:1-10:1, a rotating speed of 150 rpm-250 rpm, and a milling duration of 36-48 hours.

8. The method of claim 3, wherein in the step of preparing $Ni_3Al$ powder, ball-milling is performed with ethanol as milling dispersant and carbide ball as milling media, a mass ratio of ball to material of 5:1-10:1, a rotating speed of 150 rpm-250 rpm, and a milling duration of 12-24 hours, and vacuum heating is performed at a temperature of 1000° C.-1200° C. for a duration of 1-1.5 hours.

9. The method of claim 3, wherein in the step of ball-mill mixing, ball-milling is performed with ethanol as milling dispersant and carbide ball as milling media, a mass ratio of ball to material of 7:1-10:1, a rotating speed of 150 rpm-250 rpm, and a milling duration of 36-48 hours.

10. The method of claim 4, wherein in the step of preparing $Ni_3Al$ powder, ball-milling is performed with ethanol as milling dispersant and carbide ball as milling media, a mass ratio of ball to material of 5:1-10:1, a rotating speed of 150 rpm-250 rpm, and a milling duration of 12-24 hours, and vacuum heating is performed at a temperature of 1000° C.-1200° C. for a duration of 1-1.5 hours.

11. The method of claim 4, wherein in the step of ball-mill mixing, ball-milling is performed with ethanol as milling dispersant and carbide ball as milling media, a mass ratio of ball to material of 7:1-10:1, a rotating speed of 150 rpm-250 rpm, and a milling duration of 36-48 hours.

12. The method of claim 5, wherein in the step of preparing $Ni_3Al$ powder, ball-milling is performed with ethanol as milling dispersant and carbide ball as milling media, a mass ratio of ball to material of 5:1-10:1, a rotating speed of 150 rpm-250rpm, and a milling duration of 12-24 hours, and vacuum heating is performed at a temperature of 1000° C.-1200° C. for a duration of 1-1.5 hours.

13. The method of claim 5, wherein in the step of ball-mill mixing, ball-milling is performed with ethanol as milling dispersant and carbide ball as milling media, a mass ratio of ball to material of 7:1-10:1, a rotating speed of 150 rpm-250 rpm, and a milling duration of 36-48 hours.

* * * * *